US009822971B2

(12) United States Patent
Lee

(10) Patent No.: US 9,822,971 B2
(45) Date of Patent: Nov. 21, 2017

(54) SEPARABLE BURNER DEVICE

(71) Applicant: Pro-Iroda Industries, Inc., Taichung (TW)

(72) Inventor: Yung-Chieh Lee, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 424 days.

(21) Appl. No.: 14/665,006

(22) Filed: Mar. 23, 2015

(65) Prior Publication Data

US 2016/0281980 A1 Sep. 29, 2016

(51) Int. Cl.

| | |
|---|---|
| ***F23D 14/28*** | (2006.01) |
| ***F23D 14/46*** | (2006.01) |
| ***F23D 14/38*** | (2006.01) |

(52) U.S. Cl.

CPC ..... *F23D 14/28* (2013.01); *F23D 14/38* (2013.01); *F23D 14/465* (2013.01)

(58) Field of Classification Search

CPC ..... F16L 37/252; F16L 37/248; F16L 37/24; F23D 14/38; F23D 14/28; F16K 17/04; F16K 31/122; F16K 31/1221

See application file for complete search history.

(56) References Cited

FOREIGN PATENT DOCUMENTS

TW I405937 8/2013

*Primary Examiner* — Jason Lau

(74) *Attorney, Agent, or Firm* — Alan D. Kamrath; Kamrath IP Lawfirm, P.A.

(57) ABSTRACT

A burner device includes a fuel tank and an ignition unit. The fuel tank includes a chamber, a first thread portion, and a check valve including a valve body. The ignition unit removably attached to the fuel tank. The ignition unit includes a second connecting portion engageable with the first thread portion, and a top pillar selectively to push against the valve body of the check valve to slide along a longitudinal axis. When the fuel in the fuel tank is depleted during the operation, a user can use a filling assembly to fill the supplemental fuel into the fuel tank or replace another fuel tank instantly to improve convenience.

12 Claims, 8 Drawing Sheets

SEPARABLE BURNER DEVICE

BACKGROUND

The present invention relates to a separable burner device and, more particularly, to a separable burner device including an ignition unit and a fuel tank both to be replaceable instantly.

Taiwan Patent No. I405937 discloses a flame control calibration structure of gas torch. The gas torch is fixedly attached on a top end of a gas bottle and controls the released amount of gas to facilitate the ignition for generating high temperature for applications, including a press switch, a gas release trigger, a gas release tube, and a flame control gear. The flame control calibration structure comprises a flexible rotary flame control switch piece that fit circumferentially over the flame control gear. An inner teeth are fixedly formed on an inside surface of a ring of the rotary flame control switch piece and cooperate with the flame control gear. A slit that is formed by splitting the ring of the rotary flame control switch piece; and an extension section formed at two sides of the slit and extended from an outer circumference of the rotary flame control switch piece. The flexibility of the rotary flame control switch piece and the slit formed by splitting the ring, fast assembling and easy and convenient calibration of released amount of gas can be readily achieved.

However, when the gas in the gas bottle is depleted during the operation, a user must fill the gas for replenishment to the gas bottle instantly. Alternatively, the user may prepare and change another standby gas torch to continue the operation. Either way, it will cause inconvenience to the user.

Thus, a need exists for novel burner device to mitigate and/or obviate the above disadvantages.

BRIEF SUMMARY

A separable burner device according to the present invention includes a fuel tank and an ignition unit. The fuel tank includes a chamber formed therein, a first connecting portion disposed on a top end thereof, and a first thread portion configured in the first connecting portion and extended along a longitudinal axis. A first depth is formed from a distal end of the first thread portion to the top end of the fuel tank along the longitudinal axis. A check valve is arranged in the first connecting portion along the longitudinal axis and allows the fuel received in the chamber to flow unidirectionally from the chamber to out of the fuel tank, and the check valve is normally closed in an initial position and includes a valve body. The ignition unit is removably attached to the top end of the fuel tank, and includes a second connecting portion disposed on a bottom end thereof, and a second thread portion formed around the second connecting portion and engageable with the first thread portion. The second connecting portion includes a channel formed therethrough, and a top pillar located in the channel to selectively push against the valve body of the check valve to slide along the longitudinal axis.

When the ignition unit is attached to the fuel tank, the top pillar pushes against the valve body of the check valve. The check valve is opened. A second depth is formed from an end of the valve body adjacent to the ignition unit to the top end of the fuel tank along the longitudinal axis, and the second depth is smaller than the first depth.

When the ignition unit is detached from the fuel tank, the top pillar is separated from the valve body of the check valve. The valve body 254 is pushed to the initial position.

The check valve is closed. A third depth is formed from an end of the valve body adjacent to the ignition unit to the top end of the fuel tank along the longitudinal axis, and the third depth is smaller than the second depth.

In an example, the first thread portion is provided with an internal thread, and the second thread portion is provided with an external thread adapted for thread engagement with the internal thread of the first thread portion.

The first connecting portion is a recess adapted to receive the projecting second connecting portion, and the first thread portion is integrally formed around an inner periphery of the first connecting portion. The second thread portion is integrally formed around an outer periphery of the second connecting portion.

The check valve includes a valve seat and a valve bonnet. The valve bonnet is connected to an end of the valve seat adjacent to the chamber. A sliding slot is formed between the valve seat and the valve bonnet. An end of the valve body is engaged through the valve seat and inserts into the sliding slot, and another end of the valve body is extended towards the top end of the fuel tank and protruded out of the sliding slot. A biasing member is arranged in the sliding slot, and two opposite ends of the biasing member are respectively abutted against the valve bonnet and the valve body, so that the biasing member is abuttable against the valve body to move away from the valve bonnet.

The first connecting portion includes an extending wall connected to a bottom end of the first thread portion and extended towards the top end of the fuel tank along the longitudinal axis. An annular space is formed between the first connecting portion and the extending wall. The extending wall is arranged between the first thread portion and the longitudinal axis, and the valve seat is in thread engagement with one side of the extending wall opposite the first thread portion.

The second connecting portion includes a sealing ring mounted around an end of the channel. When the ignition unit is attached to the fuel tank, an end of the extending wall adjacent to the ignition unit is abutted against the sealing ring. When the ignition unit is detached from the fuel tank, the end of the extending wall adjacent to the ignition unit is detached from the sealing ring.

The second connecting portion includes an anti-release member inserted into the channel and disposed around a periphery of the top pillar, and the anti-release member is abutted against one side of the sealing ring adjacent to the fuel tank.

In another example, the top pillar is configured to be removably located in the channel. An inner periphery of an anti-release member is abutted against one side of the top pillar adjacent to the fuel tank, and an outer periphery of the anti-release member is abutted against one side of the sealing ring adjacent to the fuel tank.

The fuel tank further includes a bottom cover and a filling assembly. The bottom cover is threadly connected at an bottom end of the fuel tank, and the filling assembly is threadly connected to the bottom cover.

The filling assembly includes a control valve, an interior tube, and an exterior tube. The control valve is adapted to control the fuel to flow unidirectionally into the chamber is normally closed. A length of the interior tube is larger than that of the exterior tube.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
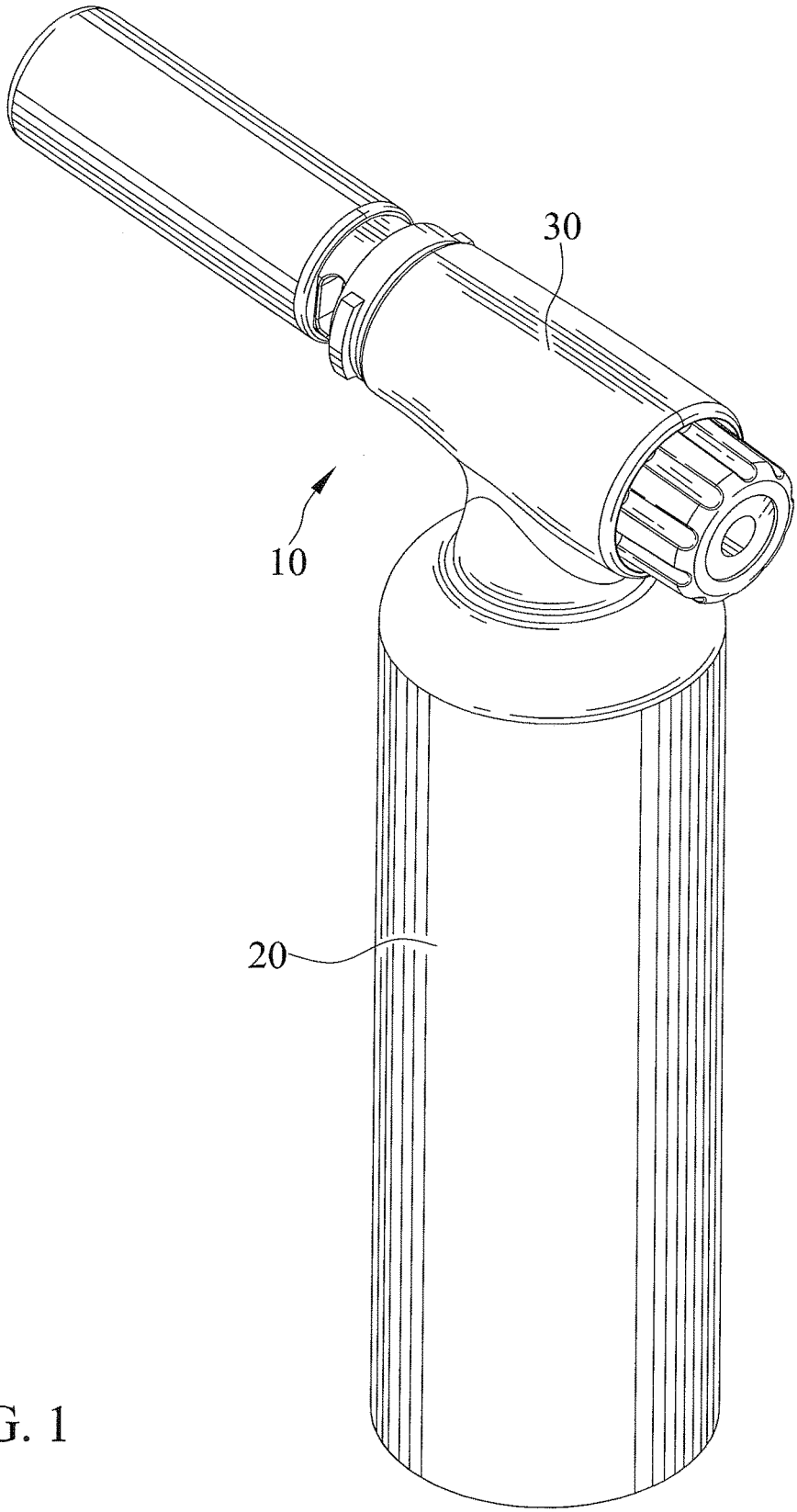
FIG. 1 is a perspective view of a separable burner device of a first embodiment according to the present invention.
Figure 2:
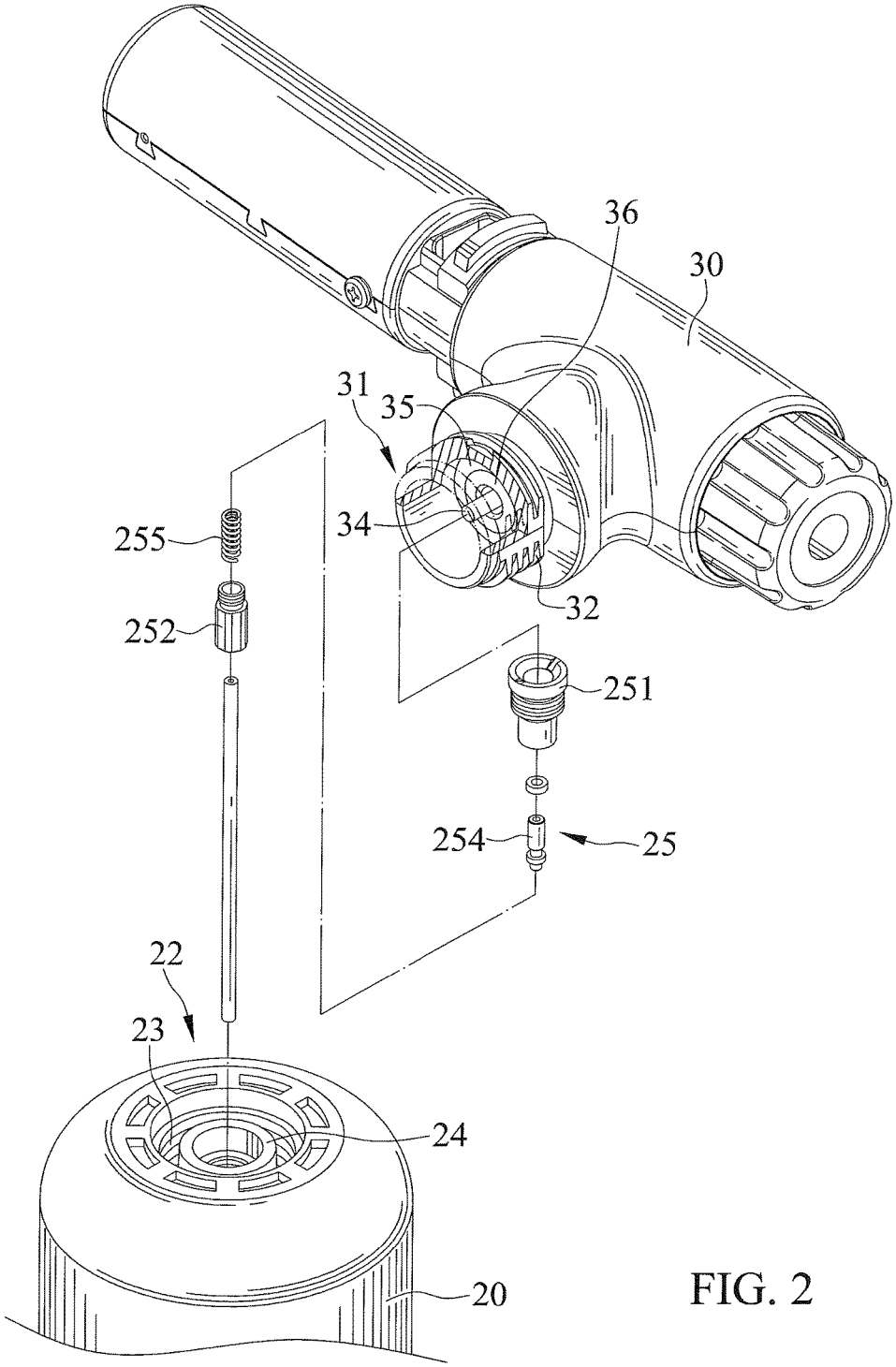
FIG. 2 is a partial, exploded perspective view of the separable burner device of FIG. 1.
Figure 3:
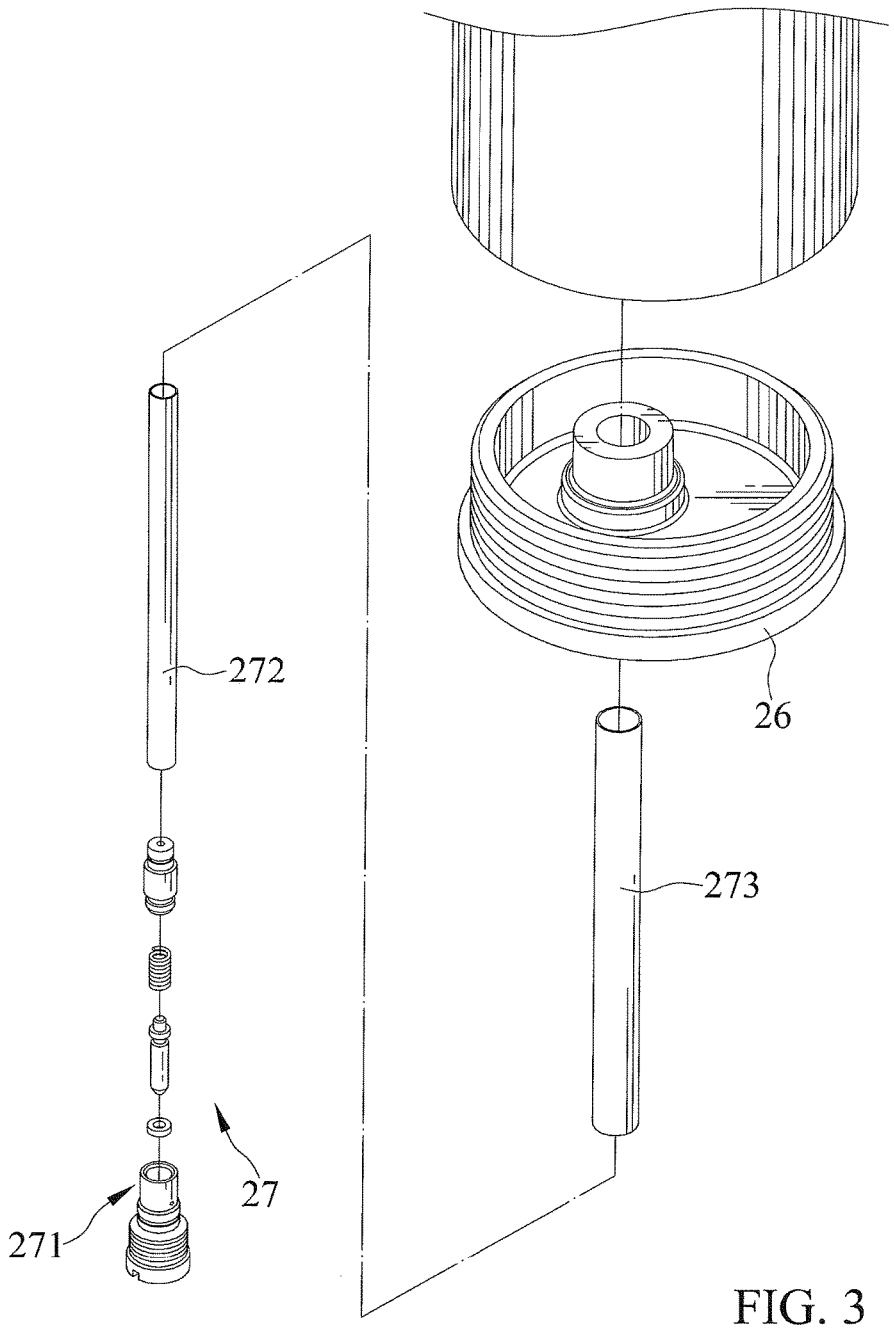
FIG. 3 is another partial, exploded perspective view of the separable burner device of FIG. 1.
Figure 4:
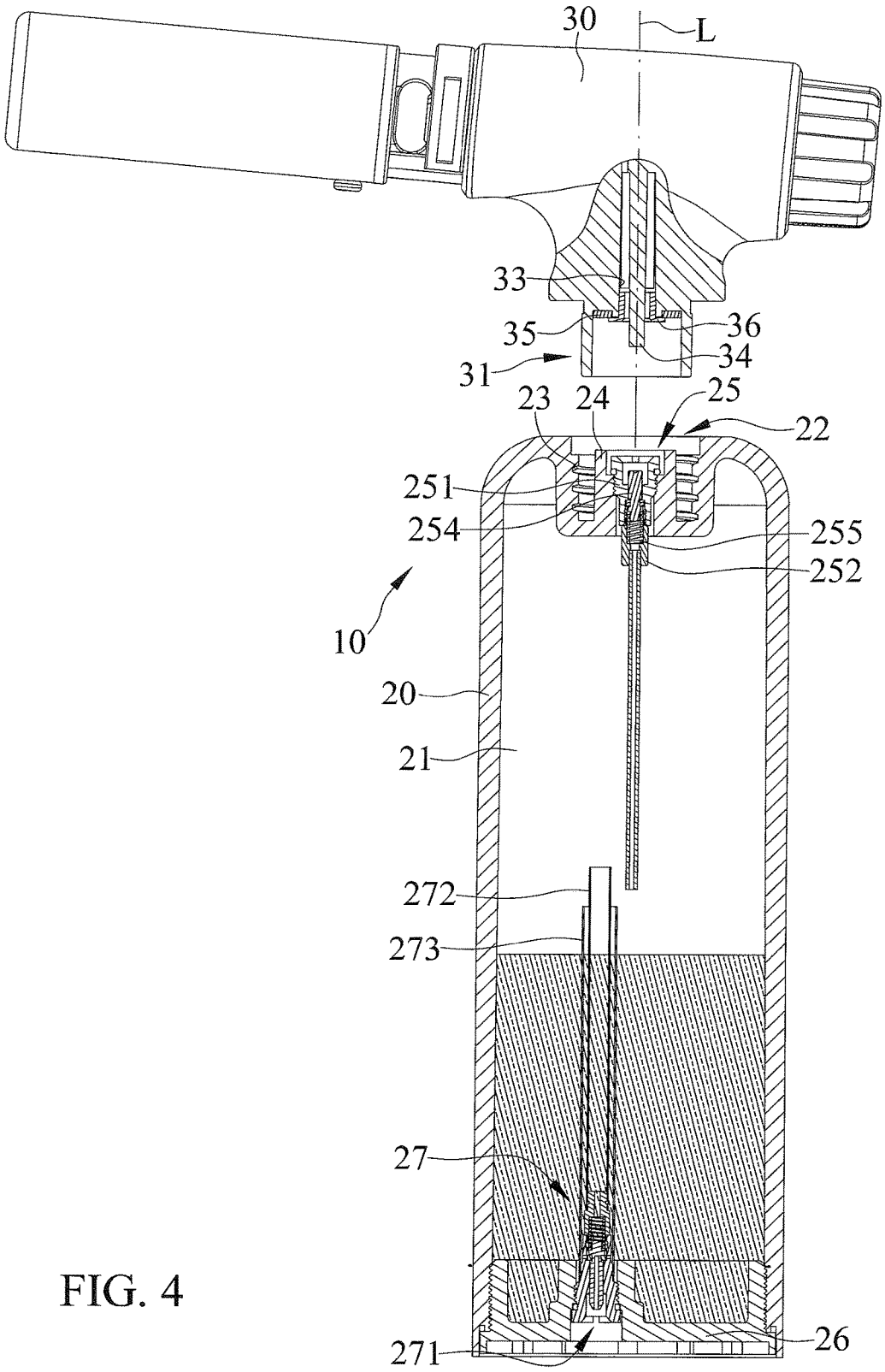
FIG. 4 is a cross sectional view of the separable burner device of FIG. 1, illustrating an ignition unit detached from a fuel tank.
Figure 5:
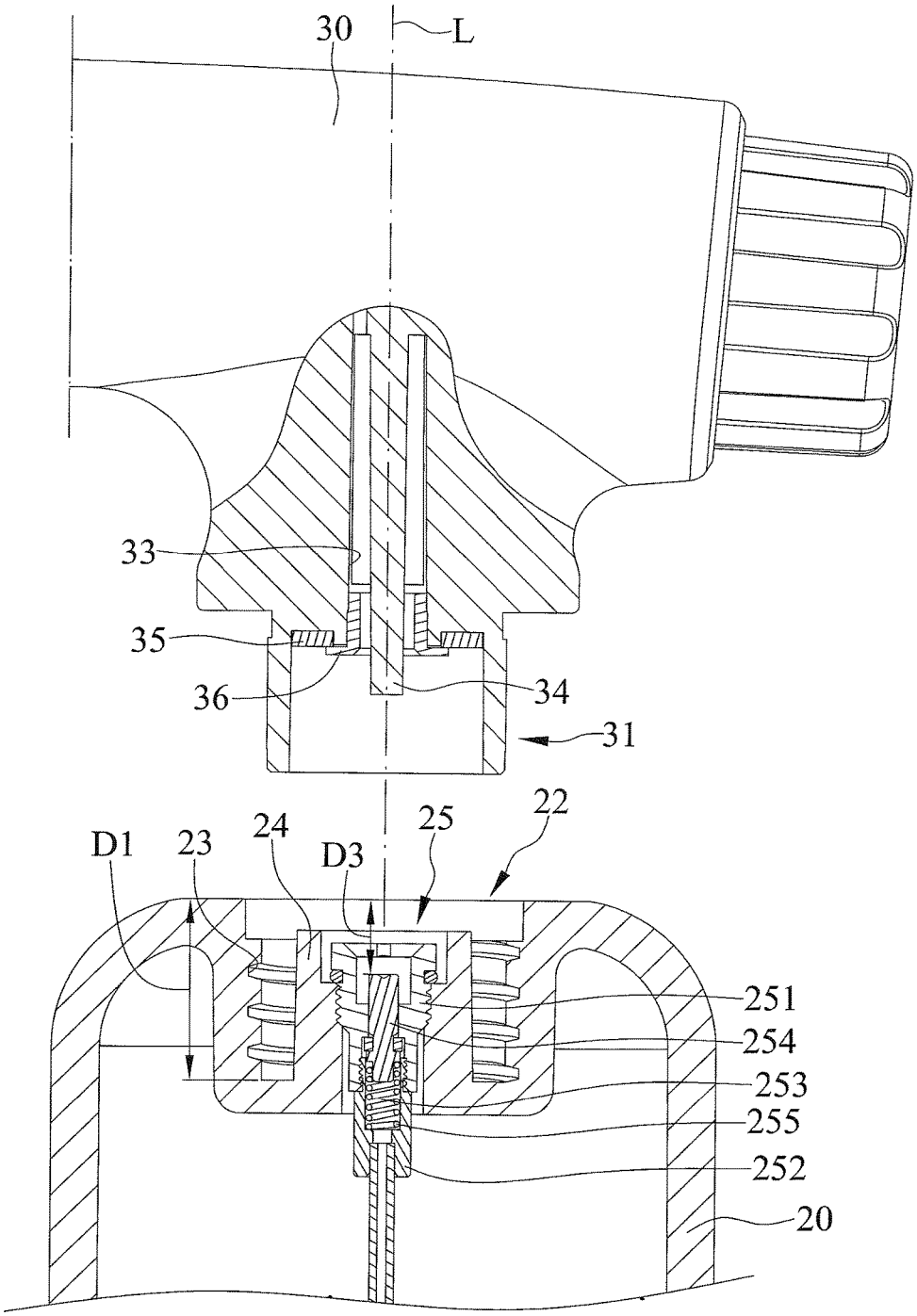
FIG. 5 is a partial, enlarged view of the separable burner device of FIG. 4.
Figure 6:
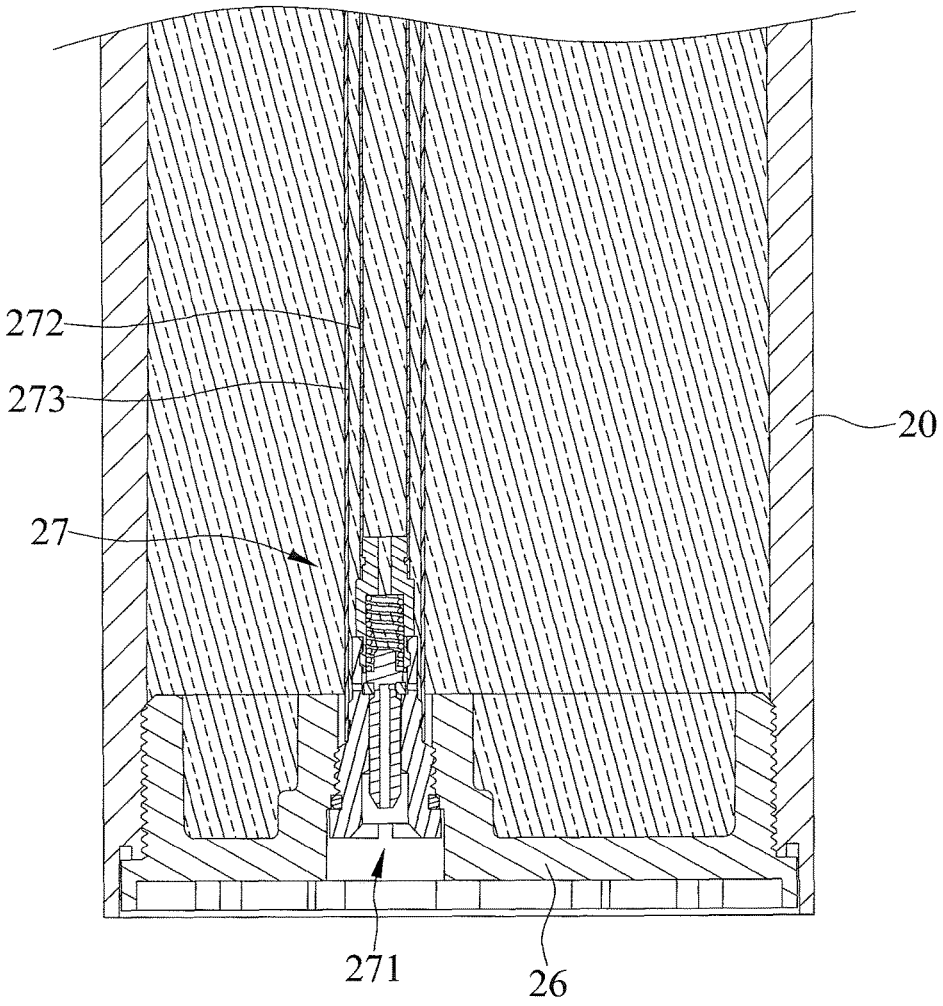
FIG. 6 is another partial, enlarged view of the separable burner device of FIG. 4.
Figure 7:
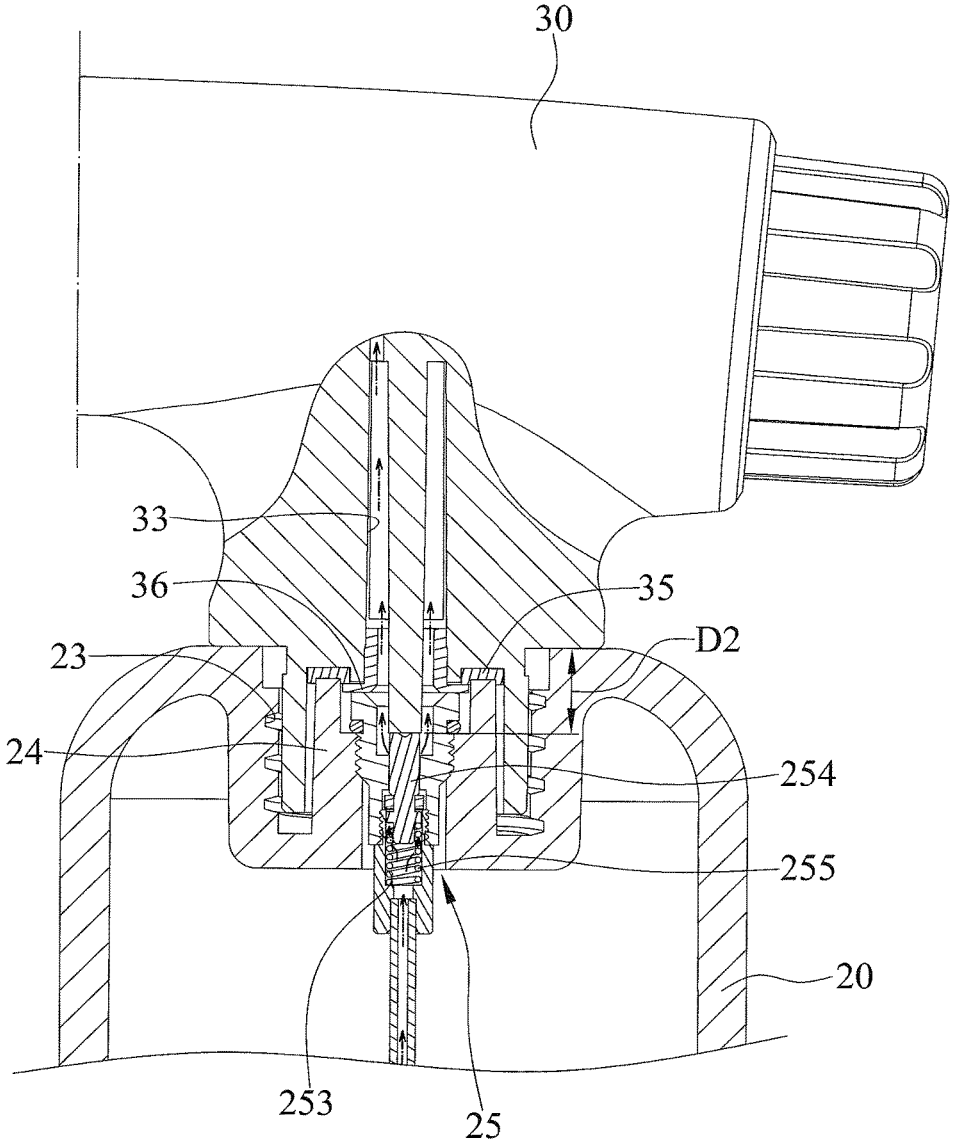
FIG. 7 is a continued view of the separable burner device of FIG. 5, illustrating the ignition unit attached to a fuel tank, and the fuel flowing unidirectionally from the fuel tank to the ignition unit.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "outer", "top", "bottom", "side", "end", "portion", "section", "longitudinal", "radial", "height", and similar terms are used herein, it should be understood that these terms have reference only to the structure shown in the drawings as it would appear to a person viewing the drawings and are utilized only to facilitate describing the illustrative embodiments.

DETAILED DESCRIPTION

FIGS. 1-7 show a separable burner device 10 of a first embodiment according to the present invention includes a fuel tank 20 and an ignition unit 30 removably attached to a top end of the fuel tank 20.

The fuel tank 20 includes a chamber 21 formed therein, a first connecting portion 22 disposed on a top end of the fuel tank 20, and a first thread portion 23 configured in the first connecting portion 22 and extended along a longitudinal axis L. In the embodiment, the first connecting portion 22 is a recess, and the first thread portion 23 is integrally formed around an inner periphery of the first connecting portion 22. Moreover, the first thread portion 23 is provided with an internal thread. A first depth D1 is formed from a distal end of the first thread portion 23 to the top end of the fuel tank 20 along the longitudinal axis L.

The first connecting portion 22 includes an annular extending wall 24 connected to a bottom end of the first thread portion 23 and extended towards the top end of the fuel tank 20 along the longitudinal axis L. An annular space is formed between the first connecting portion 22 and the extending wall 24, and the extending wall 24 is arranged between the first thread portion 23 and the longitudinal axis L.

A check valve 25 is arranged in the first connecting portion 22 along the longitudinal axis L and allows the fuel received in the chamber 21 to flow unidirectionally from the chamber 21 to out of the fuel tank 20. Thus, the check valve 25 can be opened and closed according to the ignition unit 30 attached to or detached from the top end of the fuel tank 20. The check valve 25 is normally closed in an initial position and includes a valve seat 251, a valve bonnet 252, a sliding slot 253, a valve body 254, and a biasing member 255. The valve seat 251 is in thread engagement with one side of the extending wall 24 opposite the first thread portion 23. The valve bonnet 252 is connected to an end of the valve seat 251 adjacent to the chamber 21. The sliding slot 253 is formed between the valve seat 251 and the valve bonnet 252. An end of the valve body 254 is engaged through the valve seat 251 and inserts into the sliding slot 253, and another end of the valve body 254 is extended towards the top end of the fuel tank 20 and protruded out of the sliding slot 253. The biasing member 255 is arranged in the sliding slot 253, and two opposite ends of the biasing member 255 are respectively abutted against the valve bonnet 252 and the valve body 254. In the embodiment, the biasing member 255 is a spring and abuttable against the valve body 254 to move away from the valve bonnet 252.

The fuel tank 20 further includes a bottom cover 26 and a filling assembly 27. The bottom cover 26 is threadly connected at an bottom end of the fuel tank 20. The filling assembly 27 is threadly connected to the bottom cover 26. The filling assembly 27 includes a control valve 271, an interior tube 272, and an exterior tube 273. The control valve 271 is adapted to control the fuel to flow unidirectionally into the chamber 21, and the control valve 271 is normally closed. A length of the interior tube 272 is larger than a length of the exterior tube 273.

The ignition unit 30 includes a second connecting portion 31 disposed on a bottom end thereof, and a second thread portion 32 formed around the second connecting portion 31 and engageable with the first thread portion 23. The second connecting portion 31 includes a channel 33 formed therethrough, and a top pillar 34 located in the channel 33 to selectively push against the valve body 254 of the check valve 25 to slide along the longitudinal axis L. In the embodiment, the second thread portion 32 is provided with an external thread adapted for thread engagement with the internal thread of the first thread portion 23. The second thread portion 32 is integrally formed around an outer periphery of the second connecting portion 31.

The second connecting portion 31 includes a sealing ring 35 and an anti-release member 36. The sealing ring 35 is mounted around an end of the channel 33. The anti-release member 36 is inserted into the channel 33 and disposed around a periphery of the top pillar 34. The anti-release member 36 is abutted against one side of the sealing ring 35 adjacent to the fuel tank 20.

When the ignition unit 30 is attached to the fuel tank 20, the top pillar 34 pushes against the valve body 254 of the check valve 25 to slide with respect to the sliding slot 253, and the biasing member 255 is compressed by the valve body 254. Additionally, an end of the extending wall 24 adjacent to the ignition unit 30 is abutted against the sealing ring 35. Thus, the check valve 25 is opened, so as the fuel received in the chamber 21 can flow unidirectionally from the chamber 21 to the ignition unit 30 to facilitate the ignition for generating flame for applications. A second depth D2 is formed from an end of the valve body 254 adjacent to the ignition unit 30 to the top end of the fuel tank 20 along the longitudinal axis L. The second depth D2 is smaller than the first depth D1.

When the ignition unit 30 is detached from the fuel tank 20, the top pillar 34 is separated from the valve body 254 of the check valve 25, and a returning elasticity of the biasing member 255 pushes against the valve body 254 of the check valve 25 to slide with respect to the sliding slot 253 to the initial position. Additionally, the end of the extending wall 24 adjacent to the ignition unit 30 is detached from the sealing ring 35. Thus, the check valve 25 is closed, so as the fuel received in the chamber 21 cannot flow from the chamber 21 to the ignition unit 30 to prevent the fuel to escape. A third depth D3 is formed from the end of the valve body 254 adjacent to the ignition unit 30 to the top end of the fuel tank 20 along the longitudinal axis L. The third depth D3 is smaller than the second depth D2.

Figure 8:
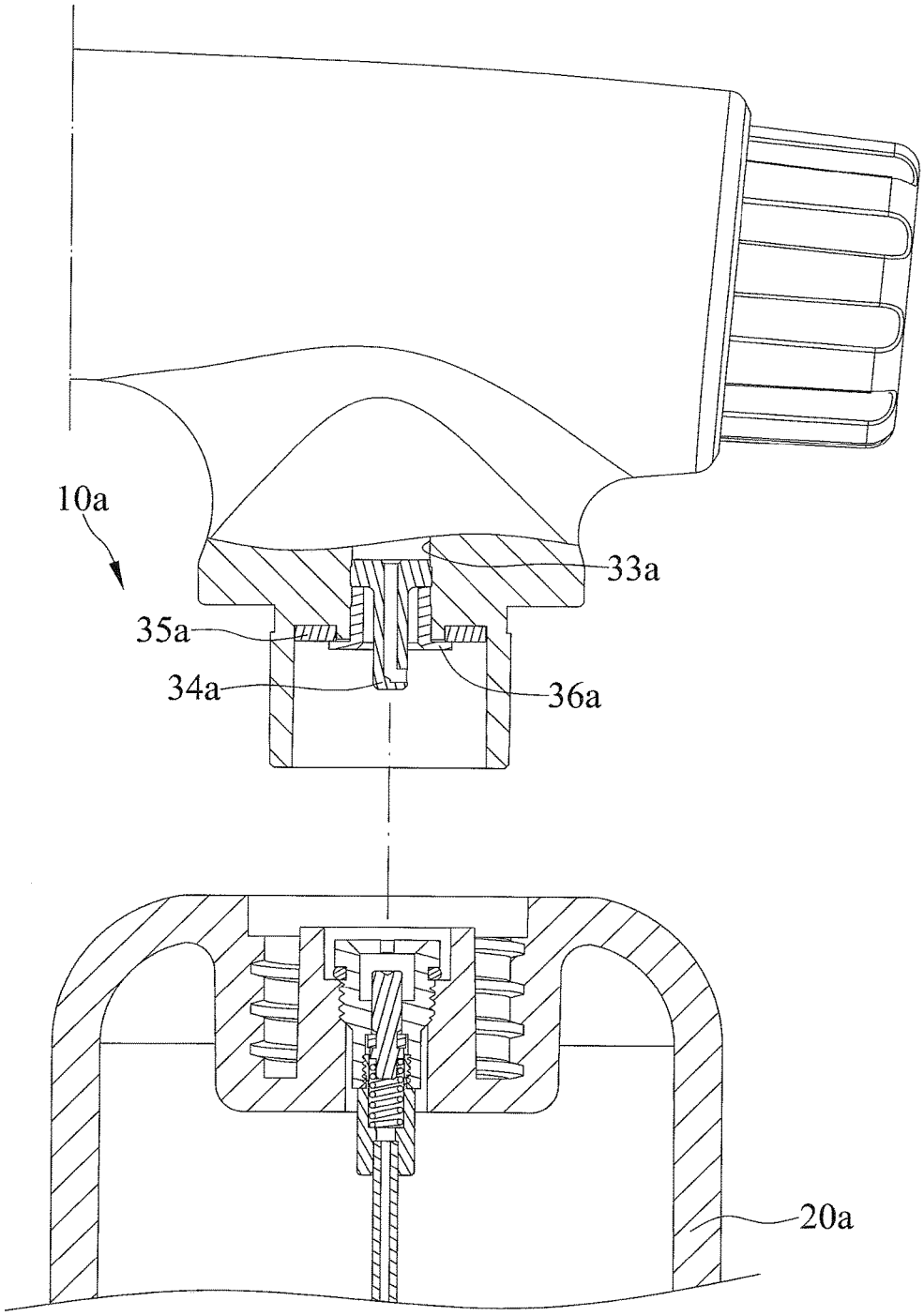
FIG. 8 is a partial, cross sectional view of the separable burner device of a second embodiment according to the present invention.

FIG. 8 shows a separable burner device 10*a* of a second embodiment according to the present invention. The second embodiment is substantially the same as the first embodiment except that the top pillar 34*a* is configured to be removably located in the channel 33*a*. An inner periphery of an anti-release member 36*a* is abutted against one side of the top pillar 34*a* adjacent to the fuel tank 20*a*. An outer periphery of the anti-release member 36*a* is abutted against one side of the sealing ring 35*a* adjacent to the fuel tank 20*a*.

In view of the foregoing, the separable burner device 10 and 10*a* according to the present invention includes the fuel tank 20 and 20*a*, and the ignition unit 30 removably attached to a top end of the fuel tank 20 and 20*a*. When the fuel in the fuel tank 20 and 20*a* is depleted during the operation, a user can use the filling assembly 27 to fill the supplemental fuel into the fuel tank 20 and 20*a*, or replace another spared fuel tank 20 and 20*a* instantly to improve convenience.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A burner device comprising:

a fuel tank including a chamber formed therein, a first connecting portion disposed on a top end thereof, and a first thread portion configured in the first connecting portion and extended along a longitudinal axis, with a first depth formed from a distal end of the first thread portion to the top end of the fuel tank along the longitudinal axis, with a check valve arranged in the first connecting portion along the longitudinal axis and allowing the fuel received in the chamber to flow unidirectionally from the chamber to out of the fuel tank, with the check valve normally closed in an initial position and including a valve body; and an ignition unit removably attached to the top end of the fuel tank, with the ignition unit including a second connecting portion disposed on a bottom end thereof, and a second thread portion formed around the second connecting portion and engageable with the first thread portion, with the second connecting portion including a channel formed therethrough, and a top pillar located in the channel to selectively push against the valve body of the check valve to slide along the longitudinal axis;

wherein when the ignition unit is attached to the fuel tank, the top pillar pushes against the valve body of the check valve, with the check valve to be opened, with a second depth formed from an end of the valve body adjacent to the ignition unit to the top end of the fuel tank along the longitudinal axis, with the second depth smaller than the first depth;

wherein when the ignition unit is detached from the fuel tank, the top pillar is separated from the valve body of the check valve, with the valve body pushed to the initial position, with the check valve to be closed, with a third depth formed from the end of the valve body adjacent to the ignition unit to the top end of the fuel tank along the longitudinal axis, with the third depth smaller than the second depth.

2. The burner device as claimed in claim 1, with the first thread portion provided with an internal thread, with the second thread portion provided with an external thread adapted for thread engagement with the internal thread of the first thread portion.

3. The burner device as claimed in claim 2, with the first connecting portion being a recess adapted to receive the projecting second connecting portion, with the first thread portion integrally formed around an inner periphery of the first connecting portion, with the second thread portion integrally formed around an outer periphery of the second connecting portion.

4. The burner device as claimed in claim 3, with the check valve including a valve seat and a valve bonnet, with the valve bonnet connected to an end of the valve seat adjacent to the chamber, with a sliding slot formed between the valve seat and the valve bonnet, with an end of the valve body engaged through the valve seat and inserting into the sliding slot, with another end of the valve body extended towards the top end of the fuel tank and protruded out of the sliding slot, with a biasing member arranged in the sliding slot, with two opposite ends of the biasing member respectively abutted against the valve bonnet and the valve body, with the biasing member abuttable against the valve body to move away from the valve bonnet.

5. The burner device as claimed in claim 4, with the first connecting portion including an extending wall connected to a bottom end of the first thread portion and extended towards the top end of the fuel tank along the longitudinal axis, with an annular space formed between the first connecting portion and the extending wall, with the extending wall arranged between the first thread portion and the longitudinal axis, with the valve seat in thread engagement with one side of the extending wall opposite the first thread portion.

6. The burner device as claimed in claim 5, with the second connecting portion including a sealing ring mounted around an end of the channel;

wherein when the ignition unit is attached to the fuel tank, an end of the extending wall adjacent to the ignition unit is abutted against the sealing ring;

wherein when the ignition unit is detached from the fuel tank, the end of the extending wall adjacent to the ignition unit is detached from the sealing ring.

7. The burner device as claimed in claim 6, with the second connecting portion including an anti-release member inserted into the channel and disposed around a periphery of the top pillar, with the anti-release member abutted against one side of the sealing ring adjacent to the fuel tank.

8. The burner device as claimed in claim 6, with the top pillar configured to be removably located in the channel, with an inner periphery of an anti-release member abutted against one side of the top pillar adjacent to the fuel tank, with an outer periphery of the anti-release member abutted against one side of the sealing ring adjacent to the fuel tank.

9. The burner device as claimed in claim 1, with the fuel tank further including a bottom cover and a filling assembly, with the bottom cover threadly connected at an bottom end of the fuel tank, with the filling assembly threadly connected to the bottom cover.

10. The burner device as claimed in claim 9, with the filling assembly including a control valve, an interior tube, and an exterior tube, with the control valve adapted to control the fuel to flow unidirectionally into the chamber, with the control valve normally closed, with a length of the interior tube larger than a length of the exterior tube.

11. The burner device as claimed in claim 8, with the fuel tank further including a bottom cover and a filling assembly, with the bottom cover threadly connected at an bottom end of the fuel tank, with the filling assembly threadly connected to the bottom cover.

12. The burner device as claimed in claim 11, with the filling assembly including a control valve, an interior tube, and an exterior tube, with the control valve adapted to control the fuel to flow unidirectionally into the chamber, with the control valve normally closed, with a length of the interior tube larger than a length of the exterior tube.

* * * * *